US012145187B2

(12) United States Patent
Yokota et al.

(10) Patent No.: US 12,145,187 B2
(45) Date of Patent: Nov. 19, 2024

(54) PRESS WORKING METHOD

(71) Applicant: MATSUMOTO HEAVY INDUSTRY CO., LTD., Kure (JP)

(72) Inventors: Koichi Yokota, Kure (JP); Shinya Shimokawa, Kure (JP)

(73) Assignee: MATSUMOTO HEAVY INDUSTRY CO., LTD., Hiroshima (JP)

( * ) Notice: Subject to any disclaimer, the term of this patent is extended or adjusted under 35 U.S.C. 154(b) by 193 days.

(21) Appl. No.: 17/800,716

(22) PCT Filed: Dec. 17, 2020

(86) PCT No.: PCT/JP2020/047207
§ 371 (c)(1),
(2) Date: Aug. 18, 2022

(87) PCT Pub. No.: WO2021/166406
PCT Pub. Date: Aug. 26, 2021

(65) Prior Publication Data

US 2023/0079039 A1 Mar. 16, 2023

(30) Foreign Application Priority Data

Feb. 20, 2020 (JP) ..... 2020-027429

(51) Int. Cl.
*B21D 28/28* (2006.01)
*B21D 28/34* (2006.01)

(52) U.S. Cl.
CPC ..... *B21D 28/28* (2013.01); *B21D 28/34* (2013.01)

(58) Field of Classification Search
CPC ..... B21D 28/28; B21D 28/34
(Continued)

(56) References Cited

U.S. PATENT DOCUMENTS 4,989,482 A * 2/1991 Mason ..... B26D 7/20 83/54
6,098,441 A 8/2000 Hada et al.
(Continued)

FOREIGN PATENT DOCUMENTS

CN 107552634 A 1/2018
GB 2331258 A 5/1999
(Continued)

OTHER PUBLICATIONS

International Search Report for International Application No. PCT/JP2020/047207; Date of Mailing, Feb. 16, 2021.
(Continued)

*Primary Examiner* — Omar Flores Sanchez
(74) *Attorney, Agent, or Firm* — CANTOR COLBURN LLP

(57) ABSTRACT

A press working method capable of forming a perforated portion with higher accuracy with respect to a workpiece being a ductile material. The press working method may comprise applying a first load to a workpiece being a ductile material with a press member to apply a preload within an elastic region of the workpiece, and then applying a second load exceeding the first load to the workpiece with the press member to provide a perforated portion in the workpiece, wherein the elastic region is larger than 0 MPa and is equal to or less than a limit shear stress value at which the workpiece is elastically deformed, the workpiece is a pipe made of metal, and the first load and the second load are applied in a state where an inside of the pipe is hollow.

7 Claims, 6 Drawing Sheets

(58) Field of Classification Search
USPC ..... 83/54, 55
See application file for complete search history.

(56) References Cited

U.S. PATENT DOCUMENTS

| | | | | |
|---|---|---|---|---|
| 7,107,808 | B2 * | 9/2006 | Miyahara | B21D 28/18 72/329 |
| 11,931,790 | B1 * | 3/2024 | Hayes | B21D 28/28 |
| 2002/0020199 | A1 * | 2/2002 | Hardtke | B21D 28/28 72/55 |
| 2003/0015011 | A1 | 1/2003 | Koyama et al. | |
| 2005/0016237 | A1 | 1/2005 | Griskiewitz et al. | |
| 2013/0000373 | A1 * | 1/2013 | Ogura | B21D 28/28 72/55 |
| 2016/0243606 | A1 * | 8/2016 | Takahashi | B21D 28/34 |
| 2018/0117659 | A1 | 5/2018 | Rose et al. | |
| 2019/0300040 | A1 * | 10/2019 | Abe | B62D 25/145 |
| 2020/0188983 | A1 * | 6/2020 | Lozano Bonet | B21D 28/002 |

FOREIGN PATENT DOCUMENTS

| | | | |
|---|---|---|---|
| JP | H05293558 | A | 11/1993 |
| JP | H0732065 | A | 2/1995 |
| JP | H11147142 | A | 6/1999 |
| JP | 2001198622 | A | 7/2001 |
| JP | 2017087224 | A | 5/2017 |

OTHER PUBLICATIONS

EPO Extended European Search Report for corresponding EP Application No. 20919417.4; Issued Feb. 19, 2024; 8 pages.

Peng Chengyun et al., "Analysis and Solutions of Defects in Pipe Punching without Core Die", Punching Die Technology, 2006, Issue 9: p. 26.

SIPA Second Examination Opinion Notice for corresponding CN Application No. 202080058972.X; Issued Sep. 25, 2024.

* cited by examiner

PRESS WORKING METHOD

CROSS REFERENCE TO RELATED APPLICATIONS

This is the U.S. national stage of application No. PCT/JP2020/047207, filed on Dec. 17, 2020. Priority under 35 U.S.C. § 119(a) and 35 U.S.C. § 365(b) is claimed from Japanese Application No. 2020-027429, filed Feb. 20, 2020, the disclosure of which is also incorporated herein by reference.

TECHNICAL FIELD

The present invention relates to a press working method.

BACKGROUND ART

Conventionally, as this type of press working method, for example, as shown in Patent Document 1, a method of forming a perforated portion by punching with respect to a workpiece is known. Patent Document 1 discloses a press working method in which a part of a workpiece is deleted to form a thin-walled portion, and then a perforated portion is formed in the thin-walled portion by a press member.

PRIOR ART DOCUMENTS

Patent Document

Patent Document 1: JP H11-147142 A

SUMMARY OF THE INVENTION

Problems to be Solved by the Invention

However, the press working method of Patent Document 1 still has room for improvement from the viewpoint of forming a perforated portion with higher accuracy with respect to a workpiece being a ductile material.

Therefore, an object of the present invention is to solve the above-described problems, and to provide a press working method capable of forming a perforated portion with higher accuracy with respect to a workpiece being a ductile material.

Means for Solving the Problems

In order to achieve the above object, the press working method according to the present invention is a press working method including: applying a first load to a workpiece being a ductile material with a press member to apply a preload within an elastic region of the workpiece; and then applying a second load exceeding the first load to the workpiece with the press member to provide a perforated portion in the workpiece, wherein the elastic region is larger than 0 MPa and is equal to or less than a limit shear stress value at which the workpiece is elastically deformed, the workpiece is a pipe made of metal, and the first load and the second load are applied in a state where an inside of the pipe is hollow.

Effects of the Invention

According to the press working method according to the present invention, the perforated portion can be formed with higher accuracy with respect to the workpiece being a ductile material.

MODE FOR CARRYING OUT THE INVENTION

Figure 1:
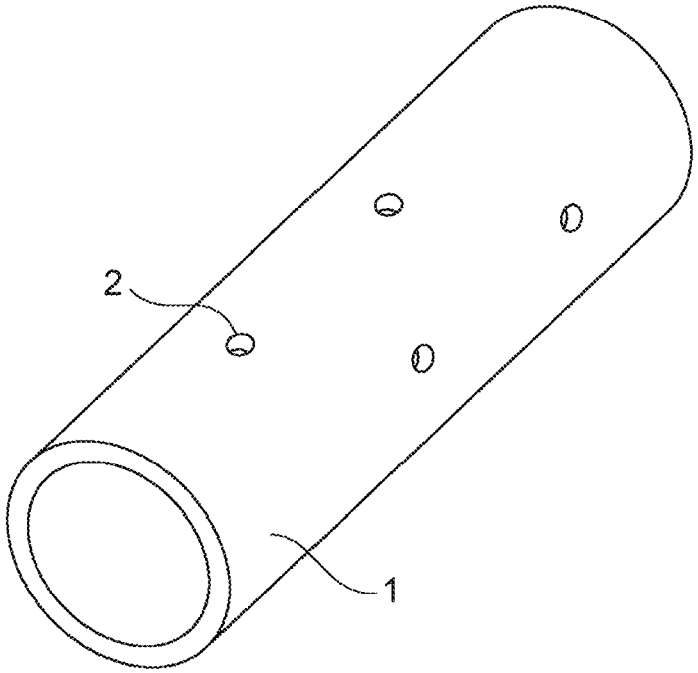
FIG. 1 is a schematic perspective view showing a pipe having a plurality of perforated portions formed by a press working method according to an embodiment of the present invention.

The press working method according to the present embodiment is a press working method including: applying a first load to a workpiece being a ductile material with a press member to apply a preload within an elastic region of the workpiece; and then applying a second load exceeding the first load to the workpiece with the press member to provide a perforated portion in the workpiece, wherein the elastic region is larger than 0 MPa and is equal to or less than a limit shear stress value at which the workpiece is elastically deformed, the workpiece is a pipe made of metal, and the first load and the second load are applied in a state where an inside of the pipe is hollow.

According to this method, the perforated portion can be formed with higher accuracy even when the press working is performed while the inside of the workpiece being a ductile material is left in a hollow state. That is, there is no need to insert a mandrel or the like inside the pipe when forming the perforated portion.

It should be noted that by applying the first load, the preload may be applied up to near the upper limit of the elastic region of the workpiece. According to this method, the perforated portion can be formed with still higher accuracy with respect to the workpiece being a ductile material.

In addition, after the first load is applied, the second load may be continuously applied. According to this method, the perforated portion can be formed with higher accuracy with respect to the workpiece being a ductile material, and the machining time can be further shortened.

In addition, after the first load is applied, the press member may be temporarily stopped, and then the second load may be applied. According to this method, the preload can be more reliably applied to the workpiece within the elastic region of the workpiece without being particularly conscious of adjusting the application speeds of the first and the second loads by the press member.

In addition, the inner diameter of the pipe may be 5 mm or less. Even in this case, according to the method, the perforated portion can be formed with higher accuracy with respect to the workpiece being a ductile material.

In addition, the diameter of the perforated portion may be 1.5 mm or less. Even in this case, according to the method, the perforated portion can be formed with higher accuracy with respect to the workpiece being a ductile material.

In addition, the press member may apply the first load by moving at a first speed with respect to the workpiece, and then, may apply the second load by moving at a constant second speed exceeding the first speed. That is, the first and second loads may be applied by changing the speed of the press member. Even in this case, the perforated portion can be formed with higher accuracy with respect to the workpiece being a ductile material.

In addition, the second speed may be 1000 mm/sec or more. According to this method, the perforated portion can be formed with higher accuracy with respect to the workpiece being a ductile material.

Hereinafter, an embodiment of the present invention will be described with reference to the drawings. It should be noted that the present invention is not limited by this embodiment. In addition, in the drawings, substantially the same members are denoted by the same reference numerals.

Embodiment

FIG. 1 is a schematic perspective view showing a pipe having a plurality of perforated portions formed by the press working method according to the present embodiment.

The pipe 1 is an example of a workpiece being a ductile material. The pipe 1 is, for example, a pipe made of steel or an aluminum alloy. The pipe 1 is formed with a plurality of perforated portions 2. In the present embodiment, the pipe 1 discharges oil through a plurality of perforated portions 2. The oil discharged from the pipe 1 is used, for example, for cooling mechanical parts or lubricating sliding members.

In order to improve the cooling efficiency of machine parts and the lubrication of sliding members, for example, it is effective to more accurately discharge the oil to be discharged from the perforated portion 2 toward a desired place without diffusing the oil as much as possible. In order to suppress the diffusion of oil, it is effective to form the perforated portion 2 with higher accuracy and smaller (for example, a diameter of 1.5 mm or less).

In addition, the perforated portion 2 is generally formed in a state of a mandrel inserted inside the pipe 1. However, it may be required to use pipe 1 in a smaller space. In this case, it is necessary to reduce the outer diameter of the pipe 1 (for example, the diameter is 8 mm or less), and accordingly, the inner diameter of the pipe 1 may be so small that the mandrel cannot be inserted (for example, the diameter is 5 mm or less). On the other hand, according to the press working method according to the present embodiment described below, the perforated portion 2 can be formed with higher accuracy with respect to the pipe 1 without using a mandrel.

Next, a press working method according to the present embodiment will be described.

Figure 2:
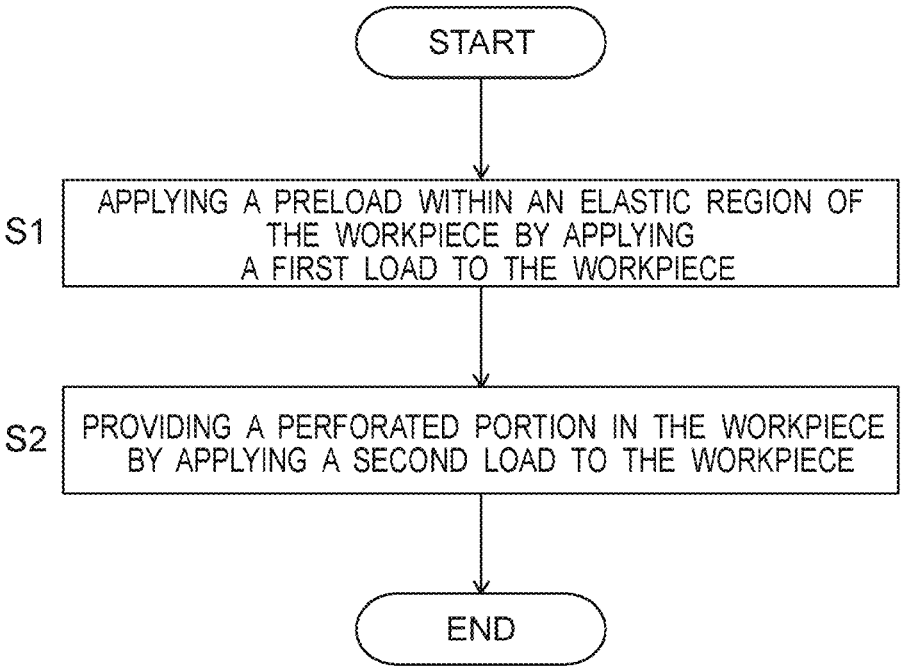
FIG. 2 is a flowchart showing the press working method according to the embodiment of the present invention.
Figure 3A:
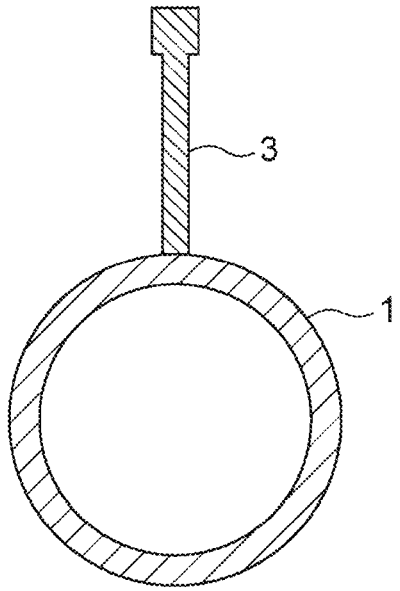
FIG. 3A is a schematic cross-sectional view showing one step of the press working method according to the embodiment of the present invention.
Figure 3B:
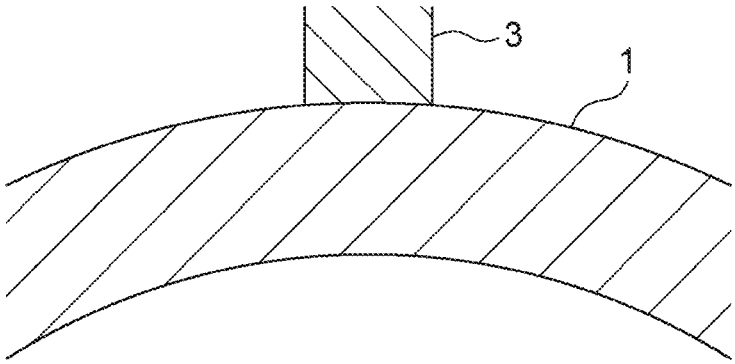
FIG. 3B is a partially enlarged cross-sectional view of FIG. 3A.

FIG. 2 is a flowchart showing a press working method according to the present embodiment. FIG. 3A is a schematic cross-sectional view showing one step of the press working method according to the present embodiment. FIG. 3B is a partially enlarged cross-sectional view of FIG. 3A.

First, as shown in FIGS. 3A and 3B, a punch pin 3 being an example of a press member applies a first load and provides a preload to the pipe 1. The first load is adjusted so that the stress generated in the pipe 1 by the first load is within the elastic region of the pipe 1 (step S1 in FIG. 2). In the invention according to the present embodiment, the elastic region is larger than 0 MPa.

Figure 4:
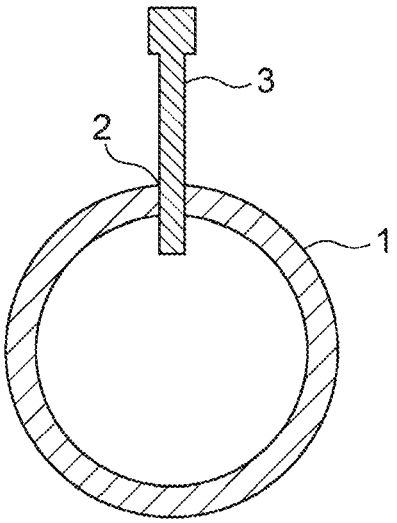
FIG. 4 is a cross-sectional view showing a step following FIG. 3A.

FIG. 4 is a cross-sectional view showing a step following GA.

Following step S1, the punch pin 3 applies a second load to the pipe 1. The second load is adjusted to exceed the first load. Due to this second load, as shown in FIG. 4, the punch pin 3 penetrates the pipe 1, and a perforated portion 2 is formed. (Step S2 in FIG. 2) In the present embodiment, the first and second loads are applied in a state where the inside of the pipe 1 is hollow without using a mandrel. In addition, in the present embodiment, the outer diameter of the pipe 1 is 18 mm. The inner diameter of the pipe 1 is 14 mm. The diameter of the perforated portion 2 is 1.2 mm.

Figure 5:
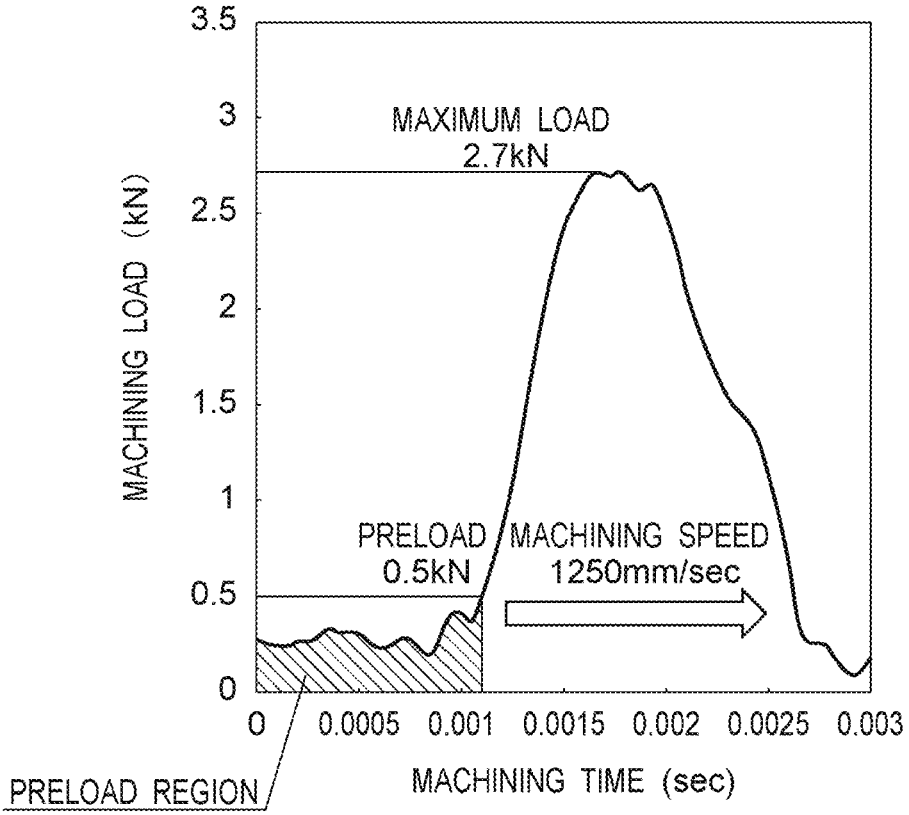
FIG. 5 is a graph showing an example of a relationship between machining time and machining load in the press working method according to the embodiment of the present invention.

Next, the relationship between the machining time and the machining load in the press working method according to the present embodiment will be described. FIG. 5 is a graph showing an example of the relationship between the machining time and the machining load in the press working method according to the present embodiment.

Here, the "machining time" is a time during which the punch pin 3 acts on the pipe 1 in order to form the perforated portion 2 in the pipe 1. In FIG. 5, the moment when the pipe 1 and the punch pin 3 start contact is set to 0 seconds. In the present embodiment, the machining time from 0 seconds to around 0.001 seconds is the period corresponding to step S1. In step S1, the punch pin 3 moves at a first speed with respect to the pipe 1. The value of the second speed in step S2 described below is set to exceed the first speed. The "machining load" is a load applied to the pipe 1 by the punch pin 3. In the present embodiment, the first load is adjusted so that the preload applied to the pipe 1 is less than 0.5 kN.

In addition, in the present embodiment, the machining time from about 0.001 seconds to about 0.003 seconds is a period corresponding to step S2. In step S2, the value of the machining load increases and reaches 2.7 kN being the maximum load during the present press working near 0.0015 seconds. Thereafter, along with the punch pin 3 penetrating the pipe 1, the machining load decreases. In step S2, a machining speed being a speed at which the punch pin 3 moves with respect to the pipe 1 and being an example of the second speed is, for example, a constant speed of 1000 mm/sec or more. In the present embodiment, the machining speed in step S2 is 1250 mm/sec.

Figure 6:
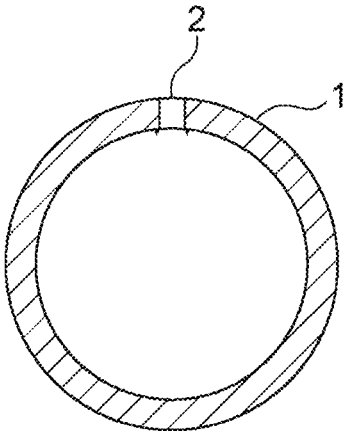
FIG. 6 is a cross-sectional view showing a pipe in which a perforated portion is formed by the press working method according to the embodiment of the present invention.
Figure 7:
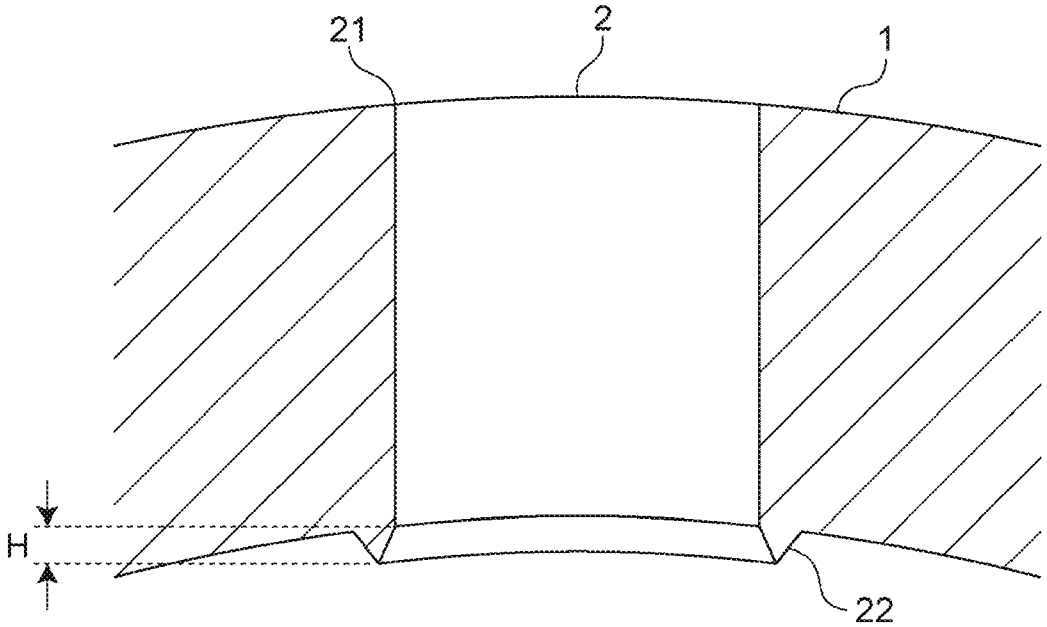
FIG. 7 is a partially enlarged cross-sectional view of FIG. 6.

FIG. 6 is a cross-sectional view showing a pipe 1 in which the perforated portion 2 is formed by the press working method according to the present embodiment. FIG. 7 is a partially enlarged cross-sectional view of FIG. 6.

Normally, when the perforated portion 2 is formed in the pipe 1 in the press working method, dents or sagging is formed in the outer peripheral portion 21 on the outer side of the perforated portion 2. In addition, burrs are formed in the outer peripheral portion 22 on the inner side of the perforated portion 2. These dents, sagging, or burrs are formed by the load applied by the punch pin 3 to the pipe 1 plastically deforming the pipe 1, without elastically deforming the pipe 1 in advance. Since dents, sagging, or burrs affect the accuracy of the discharge direction of the oil discharged from the perforated portion 2, it is desirable to make them as small as possible.

When a perforated portion 2 having a diameter of 1.2 mm was formed in a pipe 1 having an outer diameter of 18 mm and an inner diameter of 14 mm by the press working method according to the present embodiment, almost no dents or sagging occurred in the outer peripheral portion 21 on the outer side of the perforated portion 2. In addition, the height H of the burr was 0.3 mm. On the other hand, when a perforated portion 2 having a diameter of 1.2 mm was formed in a pipe 1 having an outer diameter of 18 mm and an inner diameter of 14 mm by a conventional press working method, the depth of the dent was 0.2 mm, the size of the sagging was R0.1, and the height of the burr was 0.5 mm. Thus, it was confirmed that the perforated portion 2 can be formed with higher accuracy according to the press working method according to the present embodiment.

Figure 8:
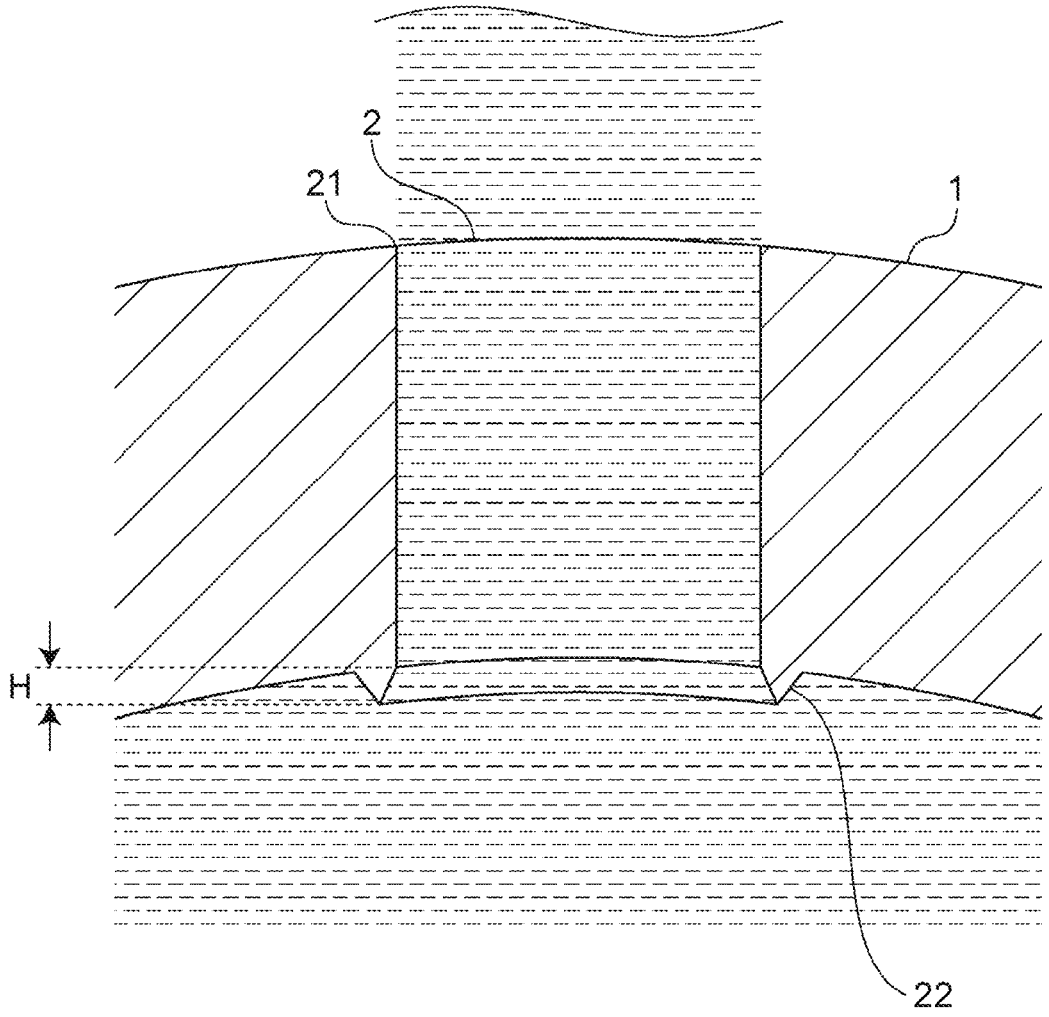
FIG. 8 is a cross-sectional view showing a state in which oil is discharged through the perforated portion shown in FIG. 7.
Figure 9:
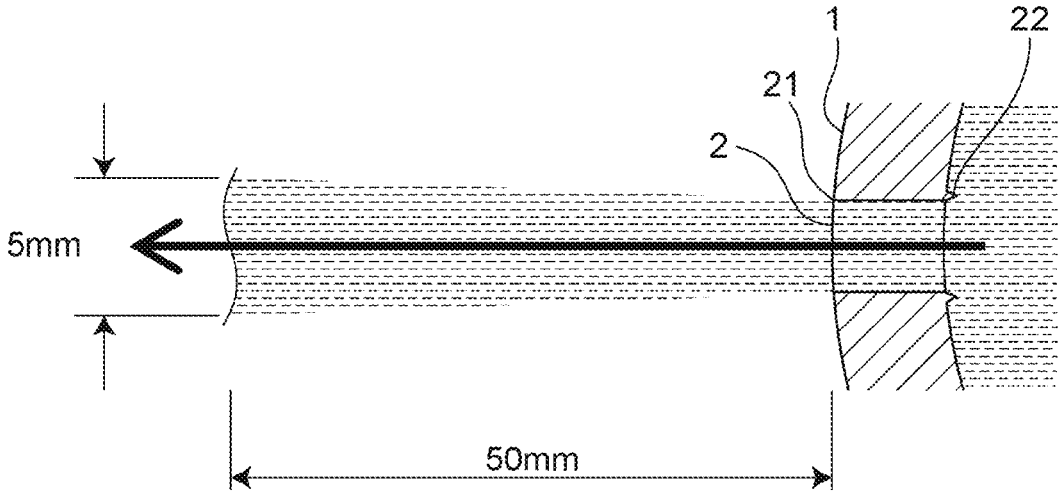
FIG. 9 is a cross-sectional view showing a state in which oil is discharged through the perforated portion formed by the press working method according to the embodiment of the present invention.

FIGS. 8 and 9 are cross-sectional views showing a state in which oil is discharged through the perforated portion 2 shown in FIG. 7.

The oil that has flowed inside the pipe 1 is discharged toward the outside of the pipe 1 through the perforated portion 2. When the outer peripheral portion 21 on the outer side of the perforated portion 2 has a dent or sagging, the oil discharged from the perforated portion 2 is attracted to the dent or sagging due to the viscosity of the oil and likely to diffuse. On the other hand, according to the press working method according to the present embodiment, since the dent or sagging in the outer peripheral portion 21 on the outer side of the perforated portion 2 can be formed to be smaller, the diffusion of oil can be further suppressed. For example, as shown in FIG. 9, the diffusion of oil can be suppressed to a range of about 5 mm in diameter at 50 mm forward of the perforated portion 2.

As described above, the press working method according to the present embodiment includes a step in which the punch pin 3 applying a first load to the pipe 1 provides a preload within the elastic region of the pipe 1. In addition, after the above step, the press working method includes a step in which the punch pin 3 applying a second load exceeding the first load to the pipe 1 provides a perforated portion 2 in the pipe 1. According to this method, a perforated portion 2 can be formed with higher accuracy with respect to the pipe 1.

It should be noted that desirably, applying the first load provides a preload up to near the upper limit of the elastic region of the pipe 1. As described above, dents, sagging, or burrs are formed by the punch pin 3 applying a load that plastically deforms the pipe 1 (that is, a second load) to the pipe 1 when the pipe 1 is not elastically deformed in advance (that is, when no preload is applied).

On the other hand, the closer the value of the stress generated in the pipe 1 by the preload approaches the upper limit of the elastic region, the smaller the dents, sagging, or burrs generated in the outer peripheral portions 21 and 22 on the outer and inner sides of the perforated portion 2 can be made, when the pipe 1 is plastically deformed by the second load. In other words, the closer the value of the stress generated in the pipe 1 by the preload approaches the plastic region in the elastic region, the smaller the dents, sagging, or burrs generated in the outer peripheral portions 21 and 22 on the outer and inner sides of the perforated portion 2 can be made, when the pipe 1 is plastically deformed by the second load. Therefore, the perforated portion 2 can be formed with higher accuracy with respect to the pipe 1.

In the present embodiment, the elastic region is larger than 0 MPa, and the "upper limit of the elastic region" is the value of the shear stress at the limit where the workpiece is elastically deformed. The value of the shear stress at the limit at which the workpiece elastically deforms is obtained by converting from the value of the yield point related to the workpiece. In addition, in the present embodiment, the "near the upper limit of the elastic region" is, for example, a range of 50% or more of the upper limit value of the elastic region and the upper limit value or less of the elastic region. Preferably, the "near the upper limit of the elastic region" is a range of 70% or more of the upper limit value of the elastic region and the upper limit value or less of the elastic region. More preferably, the "near the upper limit of the elastic region" is a range of 80% or more of the upper limit value of the elastic region and the upper limit value or less of the elastic region.

The value of the yield point is different for each workpiece, for example, based on the standard developed by what is called a standardization body such as the International Organization for Standardization (ISO). By dividing the yield point value by <3 based on von Mises yield criterion, the limit shear stress value at which the workpiece elastically deforms can be obtained. For example, according to JIS G 3445, which stipulates carbon steel tubes for machine structure in the Japanese Industrial Standards (JIS), the yield point of STKM12A is 175 MPa or more. From this, the shear yield stress of STKM12A is 101 MPa (=175/√3 MPa) or more. That is, when STKM12A is used as the workpiece, the upper limit of the elastic region is 101 MPa.

For example, according to JIS G 3445, the yield point of STKM17C is 480 MPa or more. From this, the shear yield stress of STKM17C is 277 MPa (=480/√3 MPa) or more. That is, when STKM17C is used as the workpiece, the upper limit of the elastic region is 277 MPa.

For example, according to JIS H 4080, which stipulates aluminum and aluminum alloys extruded tubes and cold-drawn tubes in JIS, the yield strength of the drawn tube of A7075-T6 is 460 MPa or more. From this, the shear yield stress of the drawn tube of A7075-T6 is 265 MPa (=460/√3 MPa) or more. That is, when the drawn tube of A7075-T6 is used as the workpiece, the upper limit of the elastic region is 265 MPa.

According to the press working method according to the present embodiment, the punch pin 3 applying a first load to the pipe 1 provides a preload within the elastic region of the pipe 1. Thereafter, the punch pin 3 applying a second load exceeding the first load to the pipe 1 provides a perforated portion 2 in the pipe 1. In addition, the elastic region is larger than 0 MPa and is less than or equal to the limit shear stress value at which the pipe 1 elastically deforms, the pipe 1 is a metal pipe, and the first load and the second load are applied in a state where the inside of the pipe 1 is hollow.

In this case, the perforated portion can be formed with higher accuracy even when the press working is performed while the inside of the workpiece being a ductile material is left in a hollow state. That is, there is no need to insert a mandrel or the like inside the pipe when forming the perforated portion.

In addition, by applying the first load, the preload may be applied up to near the upper limit of the elastic region of the pipe 1. According to this method, the perforated portion 2 can be formed with still higher accuracy with respect to the pipe 1.

In addition, after the first load is applied, the second load may be continuously applied. In this case, the perforated portion 2 can be formed with higher accuracy with respect to the pipe 1, and the machining time can be further shortened.

In addition, after the first load is applied, the press member may be temporarily stopped, and then the second load may be applied. In this case, the preload can be more reliably applied to the pipe 1 within the elastic region of the pipe 1 without being particularly conscious of adjusting the application speeds of the first load and the second load by the punch pin 3.

In addition, according to the press working method according to the present embodiment, even when the inner diameter of the pipe 1 is 5 mm or less, the perforated portion 2 can be formed with higher accuracy with respect to the pipe 1.

In addition, according to the press working method according to the present embodiment, even when the diameter of the perforated portion 2 is 1.5 mm or less, the perforated portion 2 can be formed with higher accuracy with respect to the pipe 1.

In addition, according to the press working method according to the present embodiment, the punch pin 3 may apply the first load by moving at a first speed with respect to the pipe 1, and then, may apply the second load by moving at a constant second speed exceeding the first speed. That is, the first and second loads may be applied by changing the moving speed of the punch pin 3. In this case, the perforated portion 2 can be formed with higher accuracy with respect to the pipe 1.

In addition, according to the press working method according to the present embodiment, the perforated portion 2 can be formed with higher accuracy with respect to the pipe 1 even when the second speed is 1000 mm/sec or more.

It should be noted that the present invention is not limited to the above embodiment and can be implemented in various other aspects. For example, in the above, moving the punch pin 3 with respect to the pipe 1 applies the first load to the pipe 1, and then moving the punch pin 3 applies the second load. However, the present invention is not limited to this. For example, moving the pipe 1 with respect to the punch pin 3 may apply the first load to the pipe 1, and then moving the punch pin 3 may apply the second load to the pipe 1. Even in this case, the perforated portion 2 can be formed with higher accuracy with respect to the pipe 1.

In addition, in the above, the pipe 1 having a circular cross section is shown as an example of the workpiece being a ductile material. However, the present invention is not limited to this. For example, the workpiece being a ductile material may be a plate material. Even in this case, the perforated portion 2 can be formed with higher accuracy with respect to the plate material.

The present invention has been sufficiently described in connection with the preferred embodiments with reference to the accompanying drawings, but various modifications and corrections are apparent for those skilled in the art. It should be understood that as long as such modifications and corrections do not depart from the scope of the present invention by the attached claims, they are included therein.

INDUSTRIAL APPLICABILITY

As described above, since the press working method according to the present invention can form a perforated portion in a workpiece being a ductile material with higher accuracy, for example, the method is useful as a method for machining a pipe used for cooling machine parts or the like or lubricating a sliding portion.

EXPLANATIONS OF LETTERS OR NUMERALS

1 pipe
2 perforated portion
21 outer peripheral portion on outer side of perforated portion
22 outer peripheral portion on inner side of perforated portion
3 punch pin
H height of the burr

The invention claimed is:

1. A press working method comprising:
applying a first load to a workpiece being a ductile material with a press member to apply a preload within an elastic region of the workpiece; and then
applying a second load exceeding the first load to the workpiece with the press member to provide a perforated portion in the workpiece, wherein
the elastic region is larger than 0 MPa and is equal to or less than a limit shear stress value at which the workpiece is elastically deformed,
the workpiece is a pipe made of metal, and
the first load and the second load are applied in a state where an inside of the pipe is hollow.

2. The press working method according to claim 1, wherein after the first load is applied, the second load is continuously applied.

3. The press working method according to claim 1, wherein after the first load is applied, the press member is temporarily stopped, and then the second load is applied.

4. The press working method according to claim 1, wherein an inner diameter of the pipe is 5 mm or less.

5. The press working method according to claim 1, a diameter of the perforated portion is 1.5 mm or less.

6. The press working method according to claim 1, wherein the press member applies the first load by moving at a first speed with respect to the workpiece, and then, the press member applies the second load by moving at a constant second speed exceeding the first speed.

7. The press working method according to claim 6, wherein the second speed is 1000 mm/sec or more.

* * * * *